United States Patent [19]

Eibe

[11] Patent Number: 4,553,296

[45] Date of Patent: Nov. 19, 1985

[54] SELF-CONTAINED INFLATABLE CROWN ROLL

[75] Inventor: Werner W. Eibe, Pittsburgh, Pa.

[73] Assignee: White Consolidated Industries, Inc., Cleveland, Ohio

[21] Appl. No.: 502,873

[22] Filed: Jun. 9, 1983

[51] Int. Cl.[4] ..... B21B 31/00

[52] U.S. Cl. ..... 29/113 R; 29/129

[58] Field of Search ..... 29/113 R, 113 AD, 129

[56] References Cited

U.S. PATENT DOCUMENTS

| | | | |
|---|---|---|---|
| 1,277,995 | 9/1918 | Muskett | 29/113 R |
| 3,140,512 | 7/1964 | Hausman | 29/113 A DX |
| 3,457,617 | 1/1967 | Noe et al. | 29/113 R |
| 4,062,096 | 12/1977 | Eibe | 29/113 AD |
| 4,315,346 | 2/1982 | Demuth | 29/113 R X |

FOREIGN PATENT DOCUMENTS

| | | | |
|---|---|---|---|
| 1507837 | 1/1967 | France | 29/113 AD |
| 109613 | 8/1917 | United Kingdom | 29/113 AD |

*Primary Examiner*—Howard N. Goldberg
*Assistant Examiner*—Timothy V. Eley
*Attorney, Agent, or Firm*—Walter J. Blenko, Jr.; Arnold B. Silverman

[57] ABSTRACT

A self-contained inflatable variable crown roll having a circumferential cavity between sleeve and arbor has means to connect that roll cavity to an external high pressure fluid pump when the roll is not rotating. The roll preferably has a reservoir within its arbor which is charged with hydraulic fluid and valved means connecting the roll cavity with the reservoir. The reservoir preferably encloses a fluid-tight bag which is inflated with a gas to maintain pressure therein as hydraulic fluid is withdrawn. A collecting chamber is preferably included within the arbor for receiving hydraulic fluid released from the roll of cavity.

8 Claims, 3 Drawing Figures

SELF-CONTAINED INFLATABLE CROWN ROLL

BACKGROUND OF THE INVENTION

Variable crown rolls which require no roll bending apparatus comprise an arbor with a sleeve shrunk thereon together with means for introducing hydraulic fluid under pressure between arbor and sleeve to inflate the roll so as to bow or crown its working surface. An example is the roll of Noe et al., U.S. Pat. No. 3,457,671 of July 29, 1969. An improved roll of that type is disclosed in Eibe U.S. Pat. No. 4,062,096 of Dec. 13, 1977. Those rolls require a rotating connection between the roll arbor and an external source of hydraulic fluid under pressure. As the pressure required to vary the roll crown may be too high to be readily contained by a rotating connection it is usual to build an intensifier into an end of the arbor and supply it with hydraulic fluid at lower pressure through a rotating connector. While that arrangement is workable it would be desirable to do away with all external connections to the roll while it is in operation, and it is the principal object of my invention to provide such a self-contained variable crown roll.

SUMMARY OF THE INVENTION

My self-contained roll to be described in more detail hereinafter preferably has a reservoir within its arbor which is charged with hydraulic fluid under high pressure when the roll is not rotating. A conduit with a valve operable from an end of the arbor connects the reservoir with the roll cavity. My roll preferably also has a collecting chamber within the arbor connected to the roll cavity through a conduit with an externally operated valve. The reservoir may enclose a flexible fluid-tight bag which can be inflated through an end of the roll by a gas under pressure to maintain or increase the pressure of the hydraulic fluid in the reservoir. Another embodiment of the roll of my invention has no reservoir or collecting chamber but is fitted to connect the roll cavity to an external portable high pressure fluid pump when the roll is not rotating.

DESCRIPTION OF PREFERRED EMBODIMENT

Figure 1:
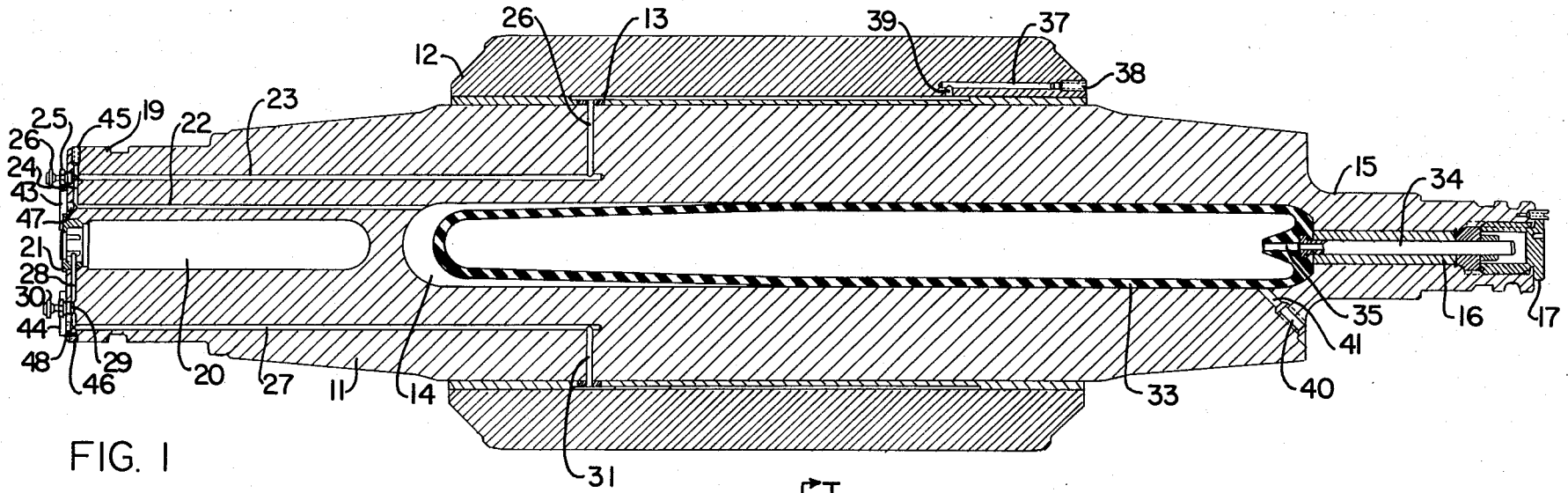
FIG. 1 is a section through a first embodiment of a variable crown roll of my invention taken on the plane I-I of FIG. 2.

In FIG. 1 my roll comprises essentially an arbor 11 having a sleeve 12 shrunk or otherwise tightly fitted thereon so as to leave a circumferential cavity 13 therebetween, which cavity has a very small radial dimension but extends along the roll beneath the working face thereof. Within arbor 11 is a longitudinal elongated reservoir cavity 14 which extends beneath the working face of sleeve 12 and toward end 15 of arbor 11. A bore 16 through end 15 gives access to reservoir 14 and is normally closed by cap 17. From the other end 19 of arbor 14 an elongated collecting chamber 20 extends inwardly toward reservoir 14. The open end of collecting chamber 20 is normally closed by cap 21. A longitudinal bore 22 extends from end 19 of arbor 11 into reservoir cavity 14. A second longitudinal bore 23 also extends from end 19 but spaced from bore 22 to a point below circumferential cavity 13, and is connected with that cavity through cross-bore 26. A cross-bore 24 near end 19 of arbor 11 connects bores 22 and 23 and extends to the circumference of arbor end 19 in a fitting 45 to be referred to later. The junction between cross-bore 24 and longitudinal bore 23 is opened or closed by valve 25, the handle 26 of which extends beyond the end face of end 19 of arbor 11. A third longitudinal bore 27 spaced from both bores 22 and 23 extends from the end face of arbor end 19 to a point below circumferential cavity 13 and is connected therewith by cross-bore 31. The outer end of bore 27 is connected with collecting chamber 20 through cross-bore 28 which includes valve 29, the handle 30 of which extends beyond the end face of end 19 of arbor 11. Cross-bore 28 also extends to the circumference of arbor end 19 in a fitting 46 to be referred to later. Inside reservoir 14 is positioned a bag 33 of stretchable fluid-tight material, such as an elastomer, having an opening 35 at its end adjacent end 15 of arbor 11. Opening 35 communicates with a tube 34 in bore 16.

A relief and bleeder valve 38 is fixed in an end of sleeve 12 and connects with circumferential cavity 13 through bore 37 and cross-bore 39. A relief valve 40 is fixed in end 15 of arbor 11 and communicates with reservoir 14 through bore 41. In end 19 of arbor 11, a pressure gauge 43 is fixed so as to connect with bore 22 and likewise a second pressure gauge 44 is fixed so as to connect with bore 27.

In the operation of the embodiment of my roll above described an inert gas such as nitrogen is pumped into bag 33 through bore 16. The gas pressure in bag 33 may be on the order of 3,000 psi and causes bag 33 to stretch so that it substantially fills reservoir 14. Then hydraulic fluid under higher pressure than the gas pressure is introduced into reservoir through fitting 45 in the end 19 of arbor 11, valve 25 being opened for this filling and valve 29 closed. Hydraulic fluid fills circumferential cavity 13 through bores 23 and 26 and flows into reservoir 14 through bore 22 compressing gas bag 33. The pressure of the hydraulic fluid may be on the order of 10,000 psi. When the filling above mentioned is completed valve 25 is closed. Fitting 45 may be a check valve which automatically closes, or may be closed by other means.

The hydraulic fluid so charged expands sleeve 12 to its maximum crown. The pressure of the hydraulic fluid in reservoir 14 is indicated by gauge 43 affixed to the face of end 19 of arbor 11 and is connected to fitting 47 of conduit 22. If the crown is greater than is desired it is reduced by opening valve 29 sufficiently to allow some of the hydraulic fluid in circumferential cavity 13 to flow out through bores 27, 28 and 31 into collecting chamber 20. The pressure of the hydraulic fluid in circumferential cavity 13 is indicated by gauge 44 also affixed to the end face of end 19 of arbor 11 and connected to conduit 27 through fitting 48. If it is subsequently desired to increase the crown of sleeve 12 valve 29 is closed and valve 25 is opened sufficiently to allow hydraulic fluid from reservoir 14 to flow through bores 22, 23, 24 and 26 into circumferential cavity 13. Bag 33 expands as hydraulic fluid is drained from reservoir 14 to maintain pressure therein. The volume of cavity 13 is quite small and the desired variation of crown is obtained by charging or draining a small quantity of hydraulic fluid. Thus the quantity of hydraulic fluid held in reservoir 14 is sufficient for a very considerable number of charges—250 to 350 or more depending on the dimensions of the roll. Collecting chamber 20 and circumferential cavity 13 are drained, if desired, through fitting 46 which may be closed by any convenient means.

A second preferred embodiment of my invention is identical with the preferred embodiment described hereinabove except that reservoir 14 has no gas-containing bag 33 or filler bore 16 in end 15 of arbor 11. In the absence of bag 33 the pressure of hydraulic fluid in reservoir 14 drops as successive charges of fluid are withdrawn and reaches a value too low to effect maximum crowning after a relatively small number of charges, on the order of 25 to 35.

Figure 2:
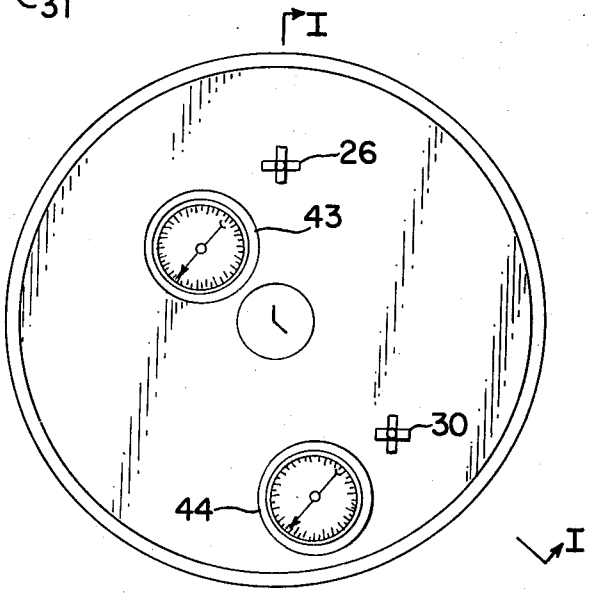
FIG. 2 is an end view to a larger scale of the roll of FIG. 1.
Figure 3:
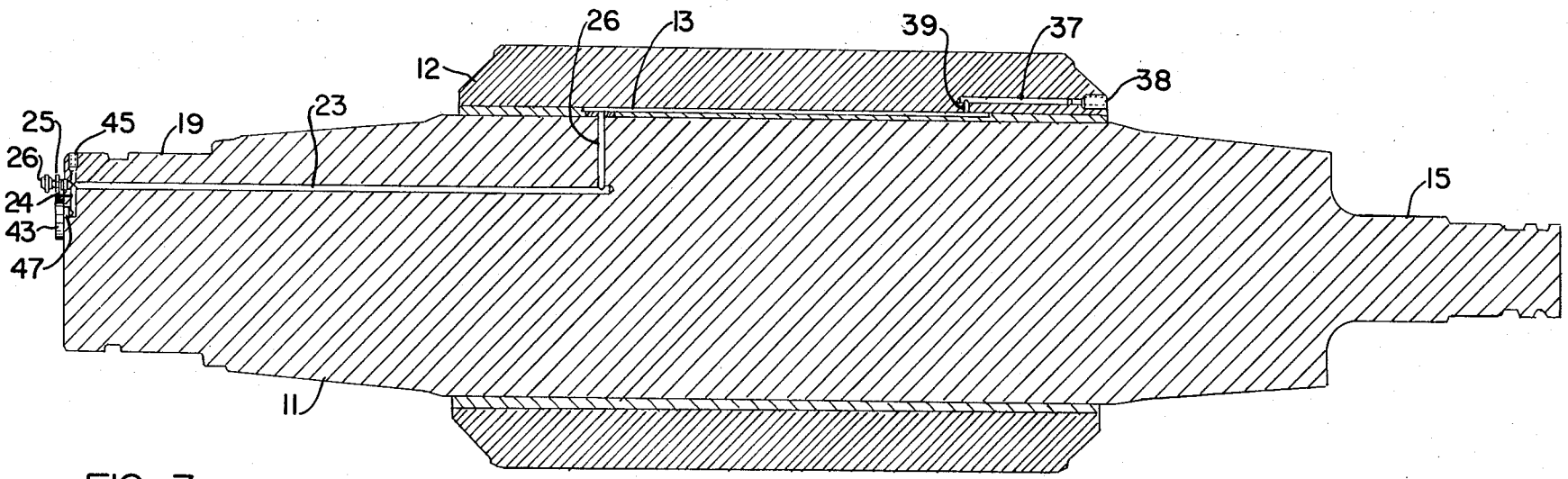
FIG. 3 is a vertical longitudinal section through a second embodiment of a variable crown roll of my invention.

A third preferred embodiment of my invention is shown in FIG. 3 hereof in which elements corresponding to those of FIG. 1 have the same reference characters as in this figure. The roll is similar to that of FIGS. 1 and 2 but has no reservoir 14 or collecting chamber 20. As in the previous embodiments the roll comprises an arbor 11 having a sleeve 12 shrunk or otherwise tightly fitted thereon so as to leave a circumferential cavity 13 therebetween. That cavity has a very small radial dimension but extends along the roll below the the working face thereof. In arbor 11 a longitudinal bore 23 extends from end 19 to a point below cavity 13 and is connected with that cavity by a cross-bore 26. A radial cross-bore 24 intersects bore 23 near the end face of end 19 of arbor 11. The outer end of cross-bore 24 terminates in a fitting 45 which may be a check valve or may be closed in any convenient way. A valve 25 is positioned at the intersection of conduit 23 and cross-bore 24 so as to close off one from another or connect them. Valve handle 26 extends outside the end face of arbor end 19. The inner end of cross-bore 24 connects through fitting 47 with pressure gauge 43 mounted on the end face of arbor end 19. A relief and air bleeder valve 38 is fitted in an end of sleeve 12 and is connected with cavity 13 through longitudinal bore 37 and cross-bore 39.

The roll of FIG. 3 is charged with hydraulic fluid from a portable small-volume high-pressure pump, not shown, which is connected to fitting 45 for that purpose and disconnected thereafter when charging is completed. That charging is carried out when the roll is not rotating. The pressure of the hydraulic fluid in cavity 13 is indicated by gauge 43. If the crown of sleeve 12 must be reduced valve 25 is opened to allow some of the hydraulic fluid to escape.

In the foregoing specification I have described presently preferred embodiments of my invention; however, it will be understood that my invention may be otherwise embodied within the scope of the following claims.

I claim:

1. In an inflatable crown roll having a circumferential cavity beneath its working face for receiving a fluid under pressure so as to crown said working face, a fitting in an end of the roll for detachably connecting a high pressure fluid pump therewith, and conduit means within the roll extending between said cavity and said fitting and including a valve operable from the end of said roll, the improvement comprising a reservoir within said roll for containing hydraulic fluid under pressure connected with said cavity by said valve positioned therebetween, the pressure in the reservoir being higher than the pressure in the cavity whereby the pressure in the cavity may be selectively increased from the reservoir by opening of said valve without connection to an external pressure source.

2. The roll of claim 1 in which said conduit comprises a longitudinal bore terminating in an end face of said roll and a cross-bore intersecting said longitudinal bore adjacent said end face and terminating on said roll end in said fitting and said valve is positioned at the intersection of said longitudinal and said cross-bores and arranged to close off or open said intersection.

3. The roll of claim 2 including pressure-indicating means mounted on said end face of said roll and connected to indicate the pressure of the hydraulic fluid in said cavity.

4. The roll of claim 1 including a collecting chamber within said roll and second valved conduit means within said roll connecting said collecting chamber with said circumferential cavity.

5. The roll of claim 1 including pressure-indicating means mounted on said end of said roll and connected to indicate the pressure of hydraulic fluid in said reservoir.

6. The roll of claim 4 including means within said roll for draining said collecting chamber.

7. In an inflatable crown roll having a circumferential cavity beneath its working face for receiving a first fluid under pressure so as to crown said working face, a fitting in an end of the roll for detachably connecting a high pressure fluid pump therewith, and conduit means within the roll extending between said cavity and said fitting and including a valve operable from the end of said roll, the improvement comprising a reservoir within said roll for containing the first fluid under pressure and connected with said cavity by said valve positioned therebetween, said reservoir also containing a second fluid under pressure, fluid-tight means positioned within the reservoir and separating the first fluid from the second fluid, and third conduit means extending from the reservoir to an end of the roll for introducing said second fluid to one side of the fluid-tight member under pressure so as to maintain pressure on the fluid-tight member and the first fluid in the reservoir.

8. The roll of claim 6 in which the fluid-tight means is a bag of resilient fluid-tight material.

* * * * *

UNITED STATES PATENT AND TRADEMARK OFFICE

CERTIFICATE OF CORRECTION

PATENT NO. : 4,553,296

DATED : November 19, 1985

INVENTOR(S) : Werner W. Eibe

It is certified that error appears in the above-identified patent and that said Letters Patent is hereby corrected as shown below:

On the title page:
Under the heading REFERENCES CITED, U.S. PATENT DOCUMENTS, Third Reference, 3,457,617, Noe et al, the date of issue should read "7/1969", not "1/1967".

Signed and Sealed this

Second Day of December, 1986

*Attest:*

DONALD J. QUIGG

*Attesting Officer*

*Commissioner of Patents and Trademarks*